United States Patent [19]

Schwulst

[11] Patent Number: 4,745,698

[45] Date of Patent: May 24, 1988

[54] WEAPON SIGHTS

[75] Inventor: Michael H. Schwulst, Pinetown, South Africa

[73] Assignee: Blenheim Gun Sights (Proprietary) Limited, Pinetown, South Africa

[21] Appl. No.: 618,837

[22] Filed: Jun. 8, 1984

[30] Foreign Application Priority Data

Jun. 10, 1983 [ZA] South Africa ..... 83/4270

[51] Int. Cl.[4] ..... F41G 1/32

[52] U.S. Cl. ..... 42/100; 33/234; 33/241

[58] Field of Search ..... 33/241, 234; 42/1 S, 42/1 ST

[56] References Cited

U.S. PATENT DOCUMENTS

| | | | |
|---|---|---|---|
| Re. 24,313 | 5/1957 | Munsey | 33/241 |
| 2,256,411 | 9/1941 | Russell | 33/241 |
| 2,488,836 | 11/1949 | Sweetman | 33/241 |
| 2,925,657 | 2/1960 | Stenby | 33/241 |
| 2,969,594 | 1/1961 | Palmer | 33/241 |
| 3,439,970 | 4/1969 | Rickert | 33/241 |
| 3,446,561 | 5/1969 | Griffin et al. | 33/241 |
| 4,434,560 | 3/1984 | Comeyne | 33/241 |

*Primary Examiner*—Donald P. Walsh
*Assistant Examiner*—Michael J. Carone
*Attorney, Agent, or Firm*—Kuhn and Muller

[57] ABSTRACT

A weapons aiming apparatus comprises a front sight (10) and a rear sight (12) mounted on a rifle (14). The front sight has a light colored or light emitting zone which is visible only to the eye looking directly through the front and rear sights. The other eye is not distracted by the front sight and may be used to view the target. The front and rear sights may be profiled in a variety of different configurations.

3 Claims, 5 Drawing Sheets

WEAPON SIGHTS

This invention relates to weapon sights and in particular to sights which enable the user to focus both eyes on a target.

According to one aspect of the invention an aiming apparatus for a weapon includes a front sight and a rear sight, the front sight including a light coloured, light reflecting or light emitting zone which is visible only by the eye looking directly through the rear and front sights, the light coloured zone being substantially obscure to the other eye and/or being completely or partially eclipsed by the rear sight when in line.

Preferably the light coloured, light reflecting or light emitting zone comprises the inner periphery of the front sight. With such an arrangement the target is preferably viewed by both eyes but the lighted or inner circle of the front sight is seen only by the aiming eye as encompassing the target.

The lighted zone is preferably constituted by a series of fibre optics positioned such that they can be viewed in a predetermined angle only. Alternatively the lighted zone is illuminated by means of a diode which is adapted to transmit light through a plurality of tunnels in the front sight.

The front sight may preferably comprises a light coloured ring which is in the form of a circular bore around the inner periphery of a bore of a tube. Alternatively the front sight may be polygonal in section to provide a maximum peripheral surface area hence increased light. The front sight is preferably star shaped having a bottom V-sight for long distance aiming. Preferably the star shaped sight is tapered from the front to the rear sight.

According to another aspect of the invention an aiming apparatus for a weapon includes a front sight and a rear sight, the front sight including a discrete peripheral rim having a surface facing the rear sight and profiled to reflect incident light in the direction of the rear sight, and the rear sight including a zone for alignment with the front sight.

Preferably the rim comprises at least a part of the sight hood which has been rendered convex or concave for reflection of light towards the aiming eye. Preferably the rear sight includes a substantially semi-circular cut out adapted on alignment of the weapon to obscure at least a part of the profiled zone of the front sight.

The sights are preferably precision injection moulded in acetal which is preferred for its dimensional stability.

Embodiments of the invention are described by way of example with reference to the accompanying drawings in which.

Figure 1:
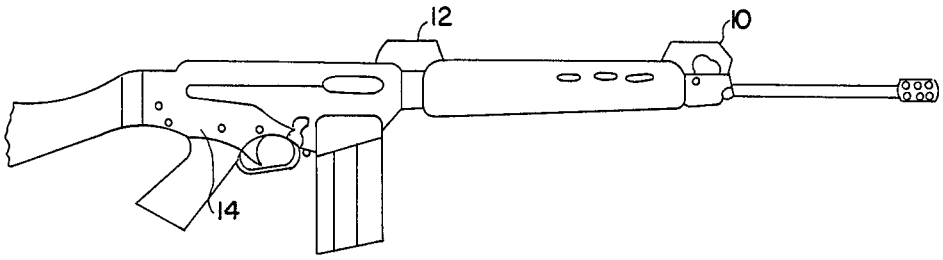
FIG. 1 is a side view of a rifle showing the sights of the invention mounted in position.

Referring to the drawings a weapons aiming apparatus comprises a front sight 10 and a rear sight 12 mounted on a R1 rifle 14.

Figure 2:
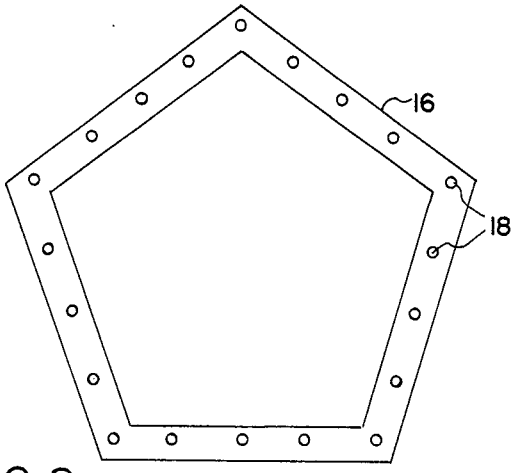
FIGS. 2 to 5 are cross sectional views of different embodiments of the front sight.

Referring to FIG. 2 the front sight takes the form of a regular pentagon 16 having fibre optics 18 provided which direct light towards the rear sight. It will be appreciated that these fibre optics may be slightly recessed into the surface of the pentagon to avoid any distraction to the eye which is not sighting directly along the barrel of the weapon.

Figure 3:
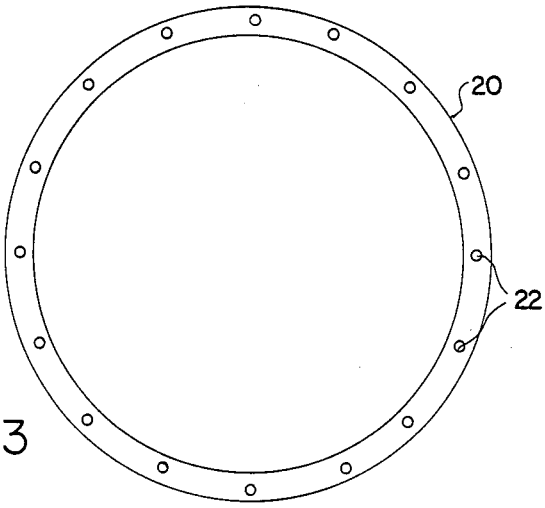

In FIG. 3 the sight 20 is of circular configuration and the fibre optics 22 are located around the periphery thereof.

Figure 4:
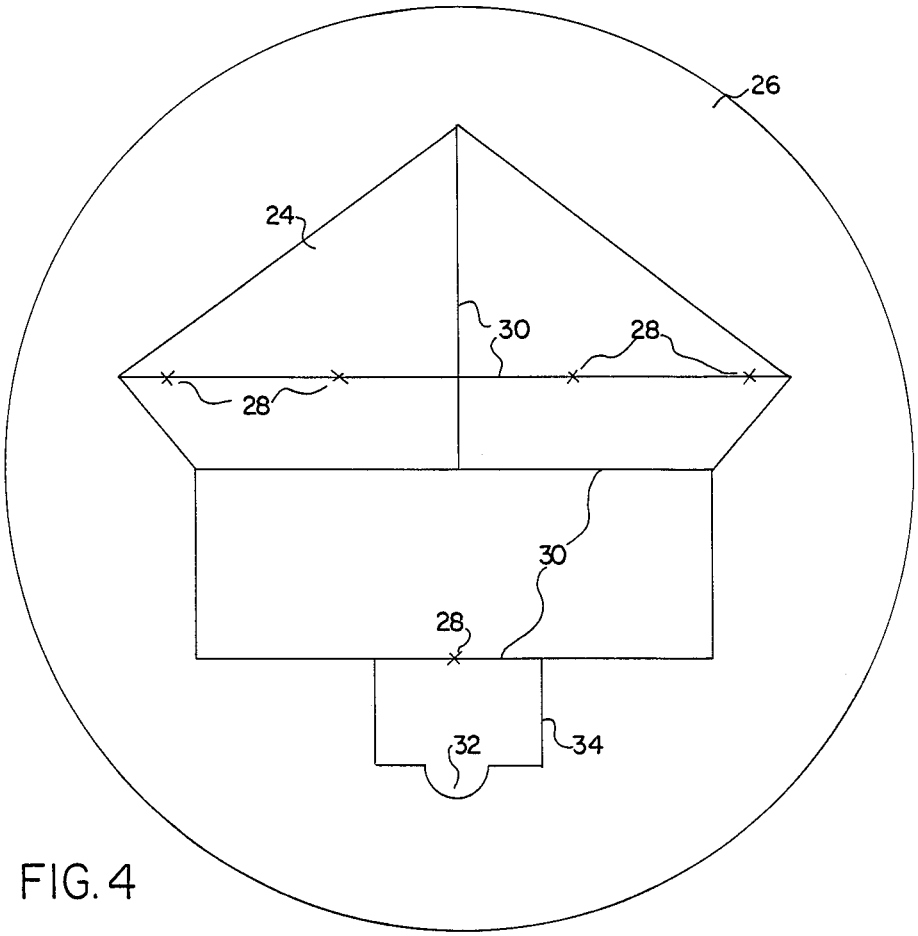

FIG. 4 illustrates an alternative embodiment of the invention where the front sight consists of an irregular aperture 24 surrounded by a coloured light reflective, or light emitting periphery 26. The aperture 24 has a series of markers 28 and cross-hairs 30 designating different ranges and distances.

It will be appreciated that if a target of known size covers a pre-determined area of the front sight the distance of the target from the viewer will be readily known.

The markers 28 or cross hairs 30 simultaneously indicate the distance of "lead" to be taken on the moving target of known speed and range and the front sight may thus be used as both an approximate rangefinder and a "lead" sight.

Additional outlines may be provided in the aperture such as shown in position 32 through which, for example, a human head may be viewed and depending on the percentage of head seen or aperture filled, the approximate range may readily be estimated. Likewise the square outline 34 may be used as an example to estimate the range of a motor vehicle.

Figure 5:
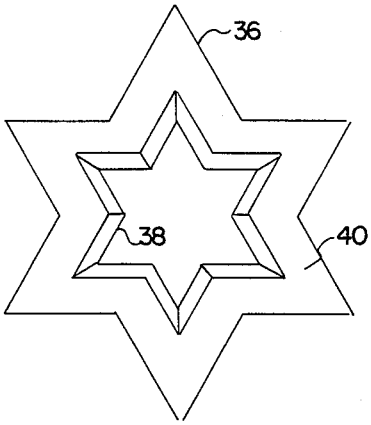

A star shaped front sight 36 having a correspondingly shaped aperture 38 seen in FIG. 5 may be provided. The zone 40 of the front sight 36 may be light coloured or rendered light reflective for positioning of the target.

Figure 6:
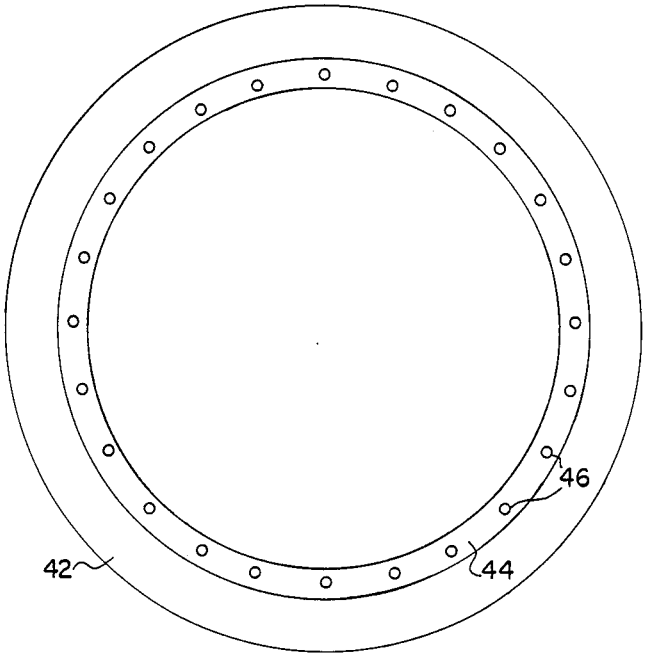
FIGS. 6 and 7 show the shottists' view of the front and rear sights.
Figure 7:
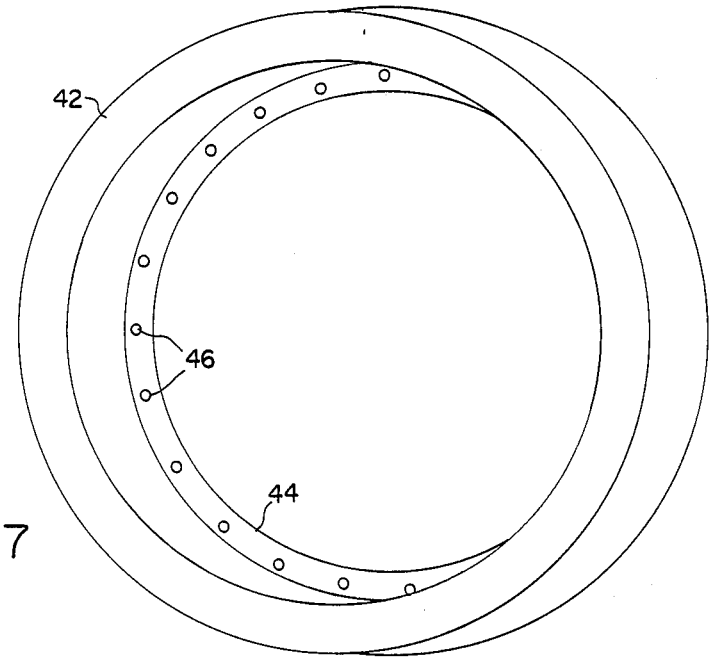

In the embodiments seen in FIGS. 6 and 7 a rear sight 42 is aligned with a front sight 44. As seen in FIG. 6 in the aligned position with the target (not seen in the drawings) and the sights 42,44 are seen as concentric circles and the fibre optics 46 are visible as an inner peripheral ring. In the partially aligned position only a part of the front sight 44 is visible. The effective viewing size of the rear sight should lie on the viewing cone subtended by the front sight.

Figure 8:
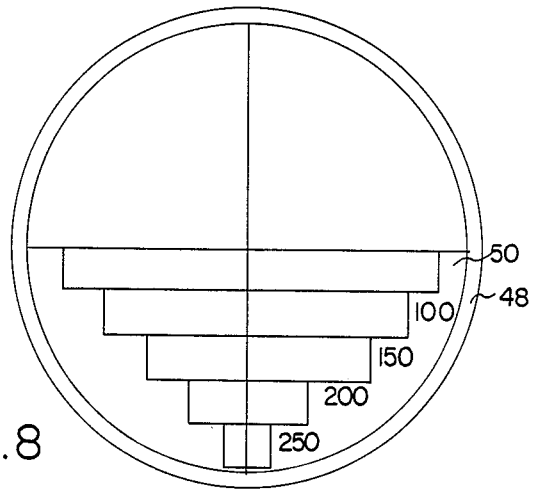
FIGS. 8 to 10 show alternative embodiments provided with cross hairs for calibration.
Figure 9:
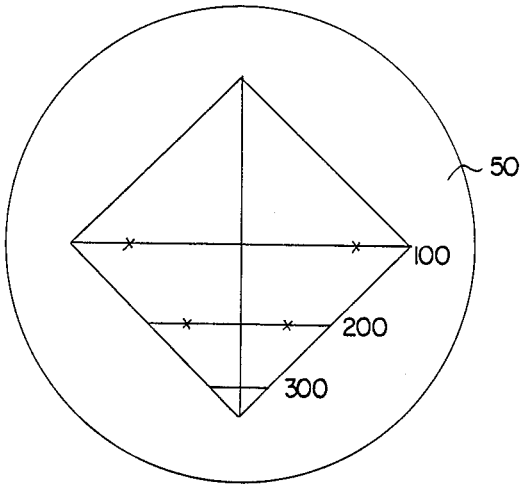
Figure 10:
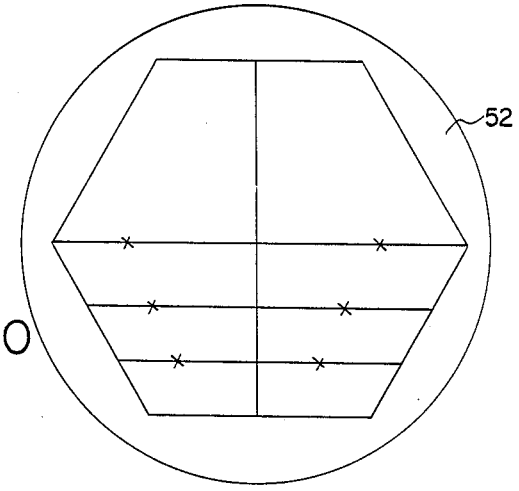

Referring to FIGS. 8, 9 and 10 front sights 48,50 and 52 are seen having calibrations for indicating the relative distance of a target. The area occupied by the target relative to the calibration gives an indication of the target distance hence enabling the shottist to determine whether he is within the shooting range of his weapon.

Figure 11:
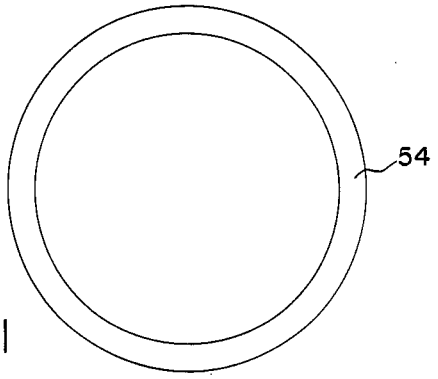
FIGS. 11 to 13 shows the front sight, rear sight and front and rear sights aligned respectively according to a further embodiment of the invention.
Figure 12:
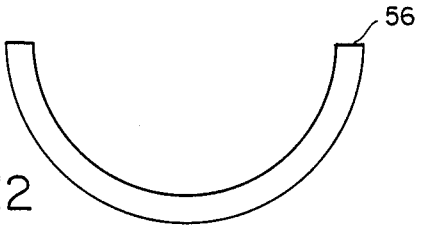
Figure 13:
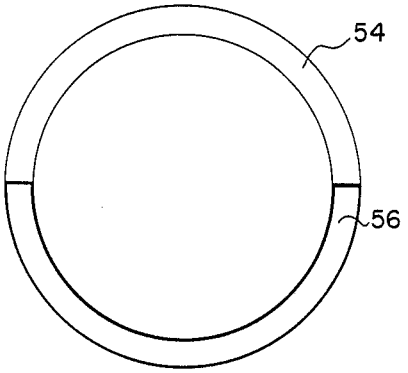

In FIGS. 11 to 13 the front sight 54 is profiled to have a convex or concave surface for reflecting light towards the rear sight 56. The surface of the front sight 54 would normally be seen as a lighted zone while the surface of the rear sight 56 is dark. On alignment of the sights the front sight 54 is obscured as seen in FIG. 13 indicating that the target is in alignment and the shottist may now fire.

I claim:

1. An aiming apparatus for a weapon including a front sight and a rear sight which are not connected to each other and each having a sight passage through which a target may be viewed, the front sight being located towards the open end of the barrel of the weapon and spaced apart from the rear sight, the front sight only having a peripheral light colored, light-reflecting or light-emitting zone surrounding the sight passage of the front sight, said zone having a surface facing toward the rear sight and profiled to direct light only in the direction of the rear sight so that light directed in the direction of the rear sight is visible only to an eye looking directly through the rear sight toward the front sight and is not visible to the other eye, said light colored, light reflecting or light emitting zone surrounding the sight passage of the front sight being at least partially eclipsed by the rear sight when the front sight, rear sight and target are in line.

2. An aiming apparatus according to claim 1, in which the light-colored, light-reflecting or light-emitting zone comprises an inner periphery of the front sight having fiber optics or a diode.

3. An aiming apparatus in accordance with claim 1 wherein the front sight only includes a discrete peripheral rim defining a surface facing the rear sight and profiled to reflect incident light in the direction of the rear sight, and the rear sight includes a zone for alignment with the front sight, effective to obscure the front sight during aiming.

* * * * *